US011176895B2

(12) United States Patent
Sun et al.

(10) Patent No.: US 11,176,895 B2
(45) Date of Patent: Nov. 16, 2021

(54) BACKLIGHT DRIVING DEVICE, DRIVING METHOD, BACKLIGHT MODULE AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Binhua Sun, Beijing (CN); Jian Sun, Beijing (CN); Feng Zi, Beijing (CN); Feng Pan, Beijing (CN); Yakun Wang, Beijing (CN); Ziqiang Guo, Beijing (CN); Hao Zhang, Beijing (CN); Lili Chen, Beijing (CN); Lin Lin, Beijing (CN); Zhen Tang, Beijing (CN); Yadong Ding, Beijing (CN); Bingxin Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/640,509

(22) PCT Filed: Aug. 21, 2019

(86) PCT No.: PCT/CN2019/101750
§ 371 (c)(1),
(2) Date: Feb. 20, 2020

(87) PCT Pub. No.: WO2020/088051
PCT Pub. Date: May 7, 2020

(65) Prior Publication Data

US 2021/0142739 A1 May 13, 2021

(30) Foreign Application Priority Data

Oct. 31, 2018 (CN) ..... 201811289196.5

(51) Int. Cl.
*G09G 3/34* (2006.01)

(52) U.S. Cl.
CPC ..... *G09G 3/342* (2013.01); *G09G 2310/08* (2013.01); *G09G 2320/064* (2013.01)

(58) Field of Classification Search
CPC ..... G09G 3/36; G09G 3/20; G09G 2310/08; G09G 2320/0626; G09G 2330/021; G09G 3/34
See application file for complete search history.

(56) References Cited

U.S. PATENT DOCUMENTS

2007/0242459 A1 10/2007 Nishigaki
2009/0066715 A1* 3/2009 Chen ..... G09G 3/3406 345/589

(Continued)

FOREIGN PATENT DOCUMENTS

CN 101055374 A 10/2007
CN 101055374 A 10/2007

(Continued)

OTHER PUBLICATIONS

First Office Action for Chinese Application No. 201811289196.5, dated Nov. 22, 2019, 6 Pages.

(Continued)

*Primary Examiner* — Olga V Merkoulova
(74) *Attorney, Agent, or Firm* — Brooks Kushman P.C.

(57) ABSTRACT

A backlight source of a backlight module of a display device is divided into N*M regions. A backlight driving device includes: an MCU configured to acquire backlight data about the N*M regions corresponding to a current display image of the display device and transmit the backlight data (Continued)

about the N*M regions to a backlight source driving circuitry in a one-tone manner; and the backlight source driving circuitry including M PWM outputs and N registers corresponding to each PWM output. The N*M registers of the backlight source driving circuitry correspond to the N*M regions respectively. The backlight source driving circuitry is configured to receive backlight data about the N*M regions from the MCU, and write the backlight data about each region into a corresponding register, so as to control luminance of the corresponding region in accordance with the backlight data.

18 Claims, 3 Drawing Sheets

(56) References Cited

U.S. PATENT DOCUMENTS

2011/0050654 A1* 3/2011 Tsutsui ..... G02B 6/0078 345/204
2011/0134158 A1* 6/2011 Onishi ..... G09G 3/3426 345/690
2014/0128941 A1* 5/2014 Williams ..... H05B 33/08 607/88
2014/0247295 A1* 9/2014 Hussain ..... G09G 3/3406 345/691
2015/0116379 A1* 4/2015 Lim ..... H05B 45/37 345/691
2015/0365621 A1 12/2015 Zhang et al.
2016/0113085 A1* 4/2016 Vaananen ..... G09G 3/36 315/185 R
2016/0335957 A1* 11/2016 Fu ..... G09G 3/36
2017/0084232 A1* 3/2017 Yang ..... G09G 3/3406
2017/0111969 A1 4/2017 Zhao
2018/0090082 A1 3/2018 Zhang
2018/0373095 A1* 12/2018 Yang ..... G02F 1/13306
2019/0197939 A1 6/2019 Wang et al.
2019/0340972 A1 11/2019 Hao et al.
2021/0142739 A1* 5/2021 Sun ..... G09G 3/342

FOREIGN PATENT DOCUMENTS

CN 101281733 A 10/2008
CN 101281733 A 10/2008
CN 101281734 A 10/2008
CN 101281734 A 10/2008
CN 105161064 A 12/2015
CN 105161064 A 12/2015
CN 105206228 A 12/2015
CN 105206228 A 12/2015
CN 105469746 A 4/2016
CN 105469746 A 4/2016
CN 105575342 A 5/2016
CN 105575342 A 5/2016
CN 106409240 A 2/2017
CN 106409240 A 2/2017
CN 107167976 A 9/2017
CN 107167976 A 9/2017
CN 108399897 A 8/2018
CN 108399897 A 8/2018
CN 109192149 A 1/2019
CN 109192149 A 1/2019
JP 2005208486 A 8/2005
JP 2005208486 A 8/2005

OTHER PUBLICATIONS

International Search Report and Written Opinion for Application No. PCT/CN2019/101750, dated Nov. 28, 2019, 10 Pages.
1st Chinese Office Action, English Translation.
International Search Report and Written Opinion, English Translation.

* cited by examiner

BACKLIGHT DRIVING DEVICE, DRIVING METHOD, BACKLIGHT MODULE AND DISPLAY DEVICE

CROSS-REFERENCE TO RELATED APPLICATIONS

This application is the U.S. national phase of PCT Application No. PCT/CN2019/101750 filed on Aug. 21, 2019, which claims priority to Chinese Patent Application No. 201811289196.5 filed on Oct. 31, 2018, which are incorporated herein by reference in their entireties.

TECHNICAL FIELD

The present disclosure relates to the field of display technology, in particular to a backlight driving device, a driving method, a backlight module and a display device.

BACKGROUND

Currently, a High-Dynamic Range (HDR) image has excellent gradations, field depth and verisimilitude, so it is able to significantly meet a visual requirement of audiences. Along with the mature of the HDR technique, it has been applied to such display products as televisions, flat-panel computers, mobile phones and Virtual Reality (VR) devices. For a direct-type backlight module, as a commonly-used backlight-module for the HDR display technique, the quantity of Light-Emitting Diode (LED) driving Integrated Circuits (ICs) increase along with an increase in the quantity of regions of a backlight plate. However, usually, a Pulse Width Modulation (PWM) driving output of the existing LED driving IC corresponds to a single register for storing parameters. Data needs to be written multiple times into the register of the PWM driving output when a time-division multiplexing function is to be achieved without increasing the quantity of the driving ICs. At this time, a workload of a Microcontroller Unit (MCU) may increase, and the processing of the other services may be adversely affected due to the frequent call interruption.

SUMMARY

In one aspect, the present disclosure provides in some embodiments a backlight driving device for a backlight module of a display device. A backlight source of the backlight module is divided into N*M regions, where M and N are each a positive integer. The backlight driving device includes: an MCU configured to acquire backlight data about the N*M regions corresponding to a current display image of the display device; and a backlight source driving circuitry including M PWM outputs and N registers corresponding to each PWM output. The N*M registers of the backlight source driving circuitry correspond to the N*M regions respectively. The backlight source driving circuitry is configured to receive backlight data about the N*M regions from the MCU, and write the backlight data about each region into a corresponding register, so as to enable each PWM output to control one or more display parameters of the corresponding region in accordance with the backlight data.

In some possible embodiments of the present disclosure, the backlight source driving circuitry is further configured to receive the backlight data about the N*M regions from the MCU in a one-time manner.

In some possible embodiments of the present disclosure, the display parameter of the corresponding region includes at least one of luminance, acutance and resolution of the corresponding region.

In some possible embodiments of the present disclosure, the backlight driving device further includes N switches connected to the MCU. Each of the N switches corresponds to M regions, and the M regions corresponding to a same switch correspond to the M PWM outputs respectively. The MCU is further configured to subject a synchronization signal to frequency multiplication by N times and transmit the multiplied synchronization signal to the N switches, so as to control the N switches to be turned on in a time-division manner. When one switch is turned on, the luminance of each of the M regions corresponding to the switch is controlled by the corresponding PWM output.

In some possible embodiments of the present disclosure, the MCU is further configured to transmit the synchronization signal multiplied by N times to the backlight source driving circuitry. Each PWM output is further configured to access the N registers corresponding to the PWM output one by one with the synchronization signal multiplied by N times as a reference, so as to control the luminance of the corresponding region in accordance with the backlight data.

In some possible embodiments of the present disclosure, the backlight driving device further includes an upper computer configured to generate original backlight data in accordance with display data about the current display image of the display device, and transmit the original backlight data and the synchronization signal to the MCU. The MCU is further configured to receive the original backlight data and the synchronization signal, and parse the original backlight data so as to acquire the backlight data about the N*M regions.

In some possible embodiments of the present disclosure, each region of the backlight source includes an LED group consisting of a plurality of LEDs connected to each other in series.

In some possible embodiments of the present disclosure, each region of the backlight source includes an LED group consisting of a plurality of LEDs connected to each other in parallel.

In some possible embodiments of the present disclosure, each region of the backlight source includes an LED group consisting of a plurality of LED subgroups connected to each other in parallel and each having LEDs connected to each other in series.

In some possible embodiments of the present disclosure, the backlight source driving circuitry is further configured to release N registers for each PWM output in accordance with a request from the MCU.

In some possible embodiments of the present disclosure, the backlight source driving circuitry is further configured to release the same quantity of registers in accordance with the quantity of N switches connected to the MCU.

In some possible embodiments of the present disclosure, the current display image of the display device is an HDR image.

In another aspect, the present disclosure provides in some embodiments a backlight driving method for the above-mentioned backlight driving device, including: acquiring, by an MCU, backlight data about N*M regions corresponding to a current display image of a display device, and transmitting the backlight data about the N*M regions to a backlight source driving circuitry; and receiving, by the backlight source driving circuitry, the backlight data about the N*M regions from the MCU, and writing the backlight data about each region into a corresponding register, so as to enable each PWM output to control one or more display parameters of the corresponding region in accordance with the backlight data.

In some possible embodiments of the present disclosure, the backlight source driving circuitry is further configured to receive the backlight data about the N*M regions from the MCU in a one-time manner.

In some possible embodiments of the present disclosure, the display parameter of the corresponding region includes at least one of luminance, acutance and resolution of the corresponding region.

In some possible embodiments of the present disclosure, the backlight driving method further includes subjecting, by the MCU, a synchronization signal to frequency multiplication by N times, and transmitting the multiplied synchronization signal to N switches, so as to control the N switches to be turned on in a time-division manner.

In some possible embodiments of the present disclosure, the backlight driving method further includes: subjecting, by the MCU, the synchronization signal to frequency multiplication by N times and transmitting the multiplied synchronization signal to a backlight source driving circuitry; and accessing, by each PWM output, N registers corresponding to the PWM output one by one with the synchronization signal multiplied by N times as a reference, so as to control the luminance of the corresponding region in accordance with the backlight data.

In some possible embodiments of the present disclosure, the backlight driving method further includes generating, by an upper computer, original backlight data in accordance with display data about the current display image of the display device, and transmitting the original backlight data and the synchronization signal to the MCU. The receiving, by the MCU, the backlight data about the N*M regions corresponding to the current display image of the display device includes receiving, by the MCU, the original backlight data and the synchronization signal, and parsing the original backlight data so as to acquire the backlight data about the N*M regions.

In some possible embodiments of the present disclosure, the backlight driving method further includes releasing, by the backlight source driving circuitry, N registers for each PWM output in accordance with a request from the MCU.

In some possible embodiments of the present disclosure, the backlight driving method further includes releasing, by the backlight source driving circuitry, the same quantity of registers in accordance with the quantity of N switches connected to the MCU.

In yet another aspect, the present disclosure provides in some embodiments a backlight module including the above-mentioned backlight driving device.

In still yet another aspect, the present disclosure provides in some embodiments a display device including the above-mentioned backlight module.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments.

An object of the present disclosure is to provide a backlight driving device, a driving method, a backlight module and a display device, so as to reduce a workload of an MCU.

Figure 1:
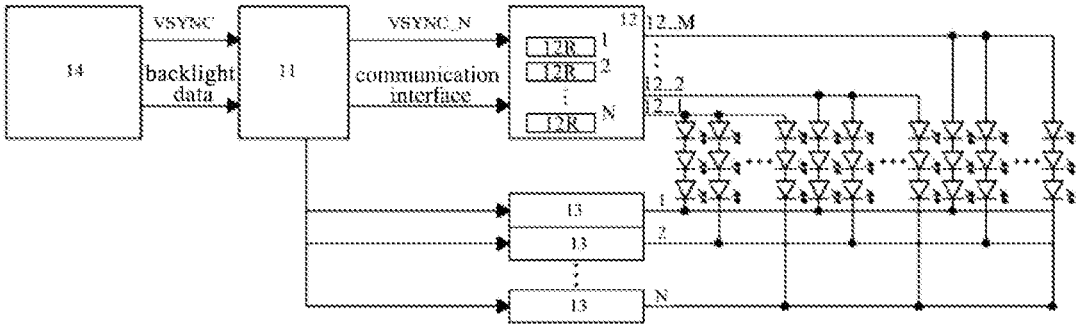
FIG. 1 is a circuit diagram of a backlight driving device according to one embodiment of the present disclosure.

The present disclosure provides in some embodiments a backlight driving device for a backlight module of a display device. A backlight source of the backlight module is divided into N*M regions, where M and N are each a positive integer. As shown in FIG. 1, the backlight driving device includes: an MCU 11 configured to acquire backlight data about the N*M regions corresponding to a current display image of the display device and transmit the backlight data about the N*M regions to a backlight source driving circuitry 12; and the backlight source driving circuitry 12 including M PWM outputs (i.e., 12_1, 12_2, . . . , 12_M to the right of 12 in FIG. 1) and N registers 12R corresponding to each PWM output. The N*M registers 12R of the backlight source driving circuitry 12 correspond to the N*M regions respectively. The backlight source driving circuitry 12 is configured to receive backlight data about the N*M regions from the MCU 11, and write the backlight data about each region into a corresponding register 12R, so as to enable each PWM output to control one or more display parameters of the corresponding region in accordance with the backlight data.

Different from an existing backlight source driving circuitry where each PWM output merely corresponds to one register, in the embodiments of the present disclosure, each of the PWM outputs 12_1, 12_2, . . . , 12_M of the backlight source driving circuitry 12 may correspond to N registers 12R, so it is able to perform multiple address allocation on each of the PWM outputs 12_1, 12_2, . . . , 12_M, write the backlight data into the N registers 12R, and output the backlight data from the N registers 12R through each of the PWM outputs 12_1, 12_2, . . . , 12_M.

In the embodiments of the present disclosure, in each display image, as an alternative mode, the MCU 11 may transmit the backlight data about the N*M regions to the backlight source driving circuitry in a one-time manner. The backlight source driving circuitry may receive the backlight data about the N*M regions from the MCU, and write the backlight data about each region into the corresponding register 12R, so as to enable each PWM output to control luminance of the corresponding region in accordance with the backlight data. In the embodiments of the present disclosure, each of the PWM outputs 12_1, 12_2, . . . , 12_M of the backlight source driving circuitry may correspond to N registers 12R, and each of the N*M registers 12R of the backlight source driving circuitry may store the backlight data about the corresponding one of the N*M regions. As a result, it is able to prevent the occurrence of such a situation where it is necessary for the MCU to transmit the data to the backlight source driving circuitry repeatedly when the backlight source driving circuitry is reused in a time-division manner, and reduce a workload of the MCU, thereby to prevent the power consumption for the MCU from being increased and prevent the processing of the other services from being adversely affected.

In some possible embodiments of the present disclosure, the backlight source driving circuitry may receive the backlight data about the N*M regions from the MCU 11 in a one-time manner.

In some possible embodiments of the present disclosure, the display parameter of the corresponding region may include, but not limited to, luminance, acutance and resolution of the corresponding region, and any other common display parameters of a backlight module.

As shown in FIG. 1, the backlight driving device may further include N switches 13 connected to the MCU 11. Each of the N switches 13 may correspond to M regions, and the M regions corresponding to a same switch 13 may correspond to the M PWM outputs 12_1, 12_2, . . . , 12_M respectively. The MCU 11 is further configured to subject a synchronization signal to frequency multiplication by N times and transmit the multiplied synchronization signal to the N switches 13, so as to control the N switches 13 to be turned on in a time-division manner. When one switch 13 is turned on, the luminance of each of the M regions corresponding to the switch 13 may be controlled by the corresponding one of the PWM outputs 12_1, 12_2, . . . , 12_M.

The MCU 11 may merely receive one synchronization signal, but it is necessary for the MCU 11 to control the N switches 13 to be turned on. Hence, it is necessary for the MCU 11 to subject the synchronization signal to frequency multiplication by N times, and transmit the synchronization signal multiplied by N times to the N switches 13 in a time-division manner, so as to control each switch 13 to be turned on upon the receipt of the synchronization signal.

The N switches 13 may correspond to the N regions respectively. When a corresponding switch 13 is turned on, the backlight data in the register 12R may be outputted through the PWM outputs 12_1, 12_2, . . . , 12_M. To be specific, a pulse signal outputted by each of the PWM outputs 12_1, 12_2, . . . , 12_M may be used to control the luminance of the corresponding region, and each of the PWM outputs 12_1, 12_2, . . . , 12_M may control the luminance of N regions through the N switches 13 respectively. The backlight source driving circuitry 12 includes the M PWM outputs 12_1, 12_2, . . . , 12_M, so it is able for the backlight source driving circuitry to control the luminance of the N*M regions.

Through designing the quantities of the switches 13 and the PWM outputs 12_1, 12_2, . . . , 12_M, it is able to control the quantity of the regions of the backlight source. When the quantity of the switches 13 increases, the quantity of the regions of the backlight resource may increase in a multifold manner. The manufacture cost of the switches 13 is smaller than that of the PWM outputs, so when it is necessary to increase the quantity of the regions of the backlight source, the quantity of the switches may be increased, so as to reduce the requirement on the backlight source driving circuitry 12, and reduce the manufacture cost of the backlight driving device. After the increase of the quantity of the switches, the backlight source driving circuitry may release the same quantity of registers in accordance with, e.g., the quantity of the switches.

The MCU 11 is further configured to transmit the synchronization signal multiplied by N times to the backlight source driving circuitry.

Each PWM output is configured to access the N registers corresponding to the PWM output one by one with the synchronization signal multiplied by N times as a reference, so as to control the luminance of the corresponding region in accordance with the backlight data.

As shown in FIG. 1, the backlight driving device may further include an upper computer 14 configured to generate original backlight data in accordance with display data about the current display image of the display device, and transmit the original backlight data and the synchronization signal to the MCU 11. The original backlight data may be backlight data about the entire backlight source.

In addition, the MCU 11 is further configured to receive the original backlight data and the synchronization signal, and parse the original backlight data so as to acquire the backlight data about the N*M regions.

In the embodiments of the present disclosure, the backlight source may be implemented through LEDs. As shown in FIG. 1, each region of the backlight source may include an LED group consisting of a plurality of LEDs connected to each other in series, or consisting of a plurality of LEDs connected to each other in parallel, or consisting of a plurality of LED subgroups connected to each other in parallel and each having LEDs connected to each other in series, which will not be particularly defined herein.

The backlight source driving circuitry 12 is further configured to release N registers for each PWM output in accordance with a request from the MCU 11.

Alternatively, the backlight source driving circuitry 12 is further configured to release the same quantity of registers in accordance with the quantity of N switches 13 connected to the MCU 11.

In some possible embodiments of the present disclosure, the current display image of the display device may be an HDR image. The HDR image has excellent gradations, field depth and verisimilitude, so it is able to significantly meet a visual requirement of audiences.

Figure 4:
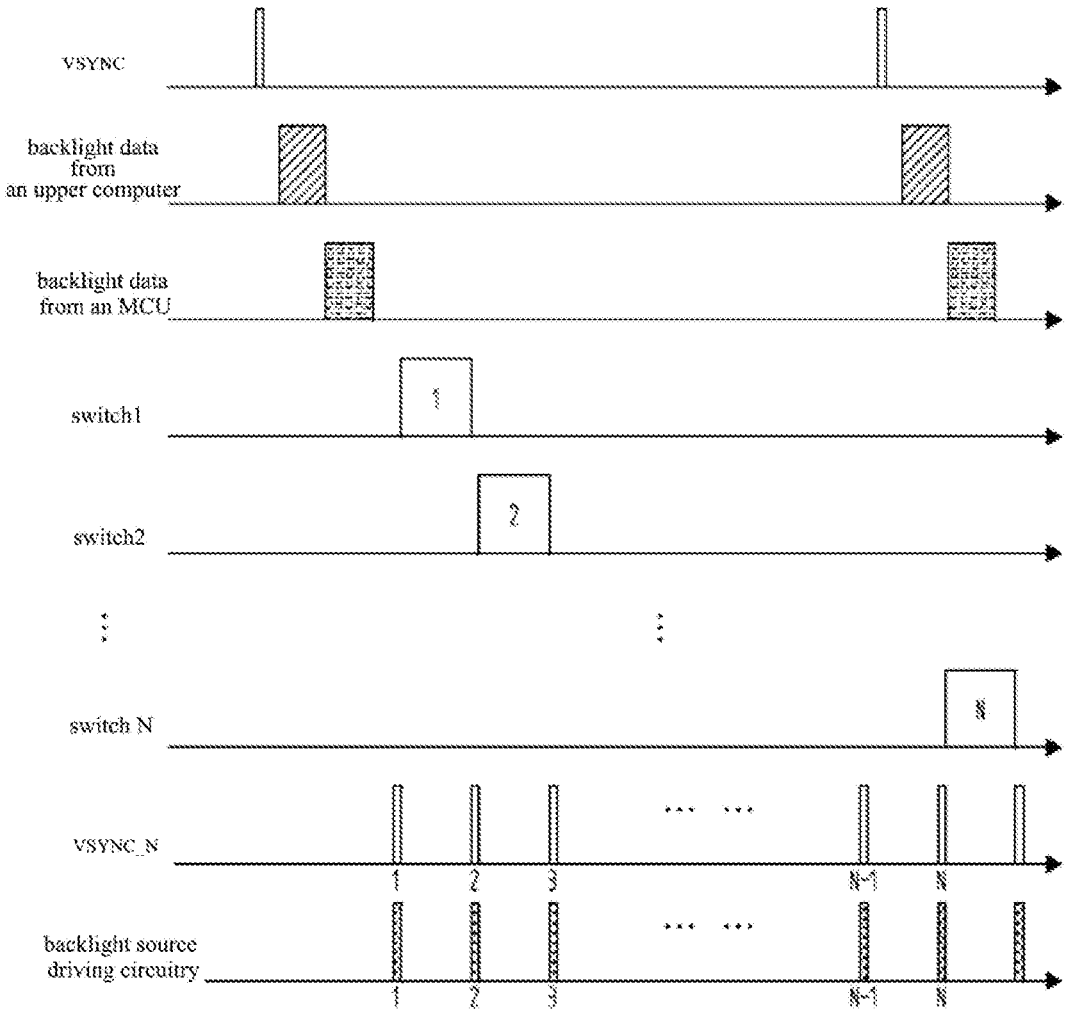
FIG. 4 is a sequence diagram of signals according to one embodiment of the present disclosure.

To be specific, as shown in FIG. 1 and FIG. 4, within a display time period for each display image of the display device, the upper computer 14 may generate the original backlight data in accordance with display data about the current display image of the display device, and transmit the original backlight data to the MCU 11 with the synchronization signal VSYNC as a reference. Upon the receipt of the backlight data, the MCU 11 may parse the original backlight data so as to acquire the backlight data about the N*M regions, transmit the backlight data about the N*M regions to the backlight source driving circuitry 12 in a one-time manner, and reset and address a start address. The MCU 11 is further configured to subject the synchronization signal VSYNC to frequency multiplication by N times to acquire VSYNC_N, and transmit VSYNC_N to the backlight source driving circuitry 12. The backlight source driving circuitry 12 may include M PWM outputs 12_1, 12_2, . . . , 12_M. Each PWM output may address storage addresses of the N registers 12R corresponding to the PWM output with an order of the inputted VSYNC_N as a reference, and access the N registers 12R corresponding to each of the PWM outputs 12_1, 12_2, . . . , 12_M one by one, so as to enable each of the PWM outputs 12_1, 12_2, . . . , 12_M to control the display parameter (luminance) of the corresponding region in accordance with the backlight data. The backlight data about the N*M regions may be updated in real time in the N registers 12R corresponding to each of the PWM outputs 12_1, 12_2, . . . , 12_M. The backlight data about one region may be stored in one register, and the backlight regions about the N*M regions may be stored in the N*M registers 12R respectively, so it is able to adjust a current for a corresponding region in accordance with the backlight data in the corresponding register, thereby to control the display parameter (luminance) of the corresponding region. Each register 12R corresponding to each of the PWM outputs 12_1, 12_2, . . . , 12_M may correspond to one switch 13 and one LED group. When the corresponding switch 13 is turned on, the backlight data stored in the corresponding register 12R may be outputted through the corresponding PWM output, so as to control the display parameter (luminance) of the corresponding LED group. The MCU 11 may control the N switches 13 to be turned on in a time-division manner in accordance with the multiplied VSYNC_N. In the embodiments of the present disclosure, within the display time period for each display image of the display device, the MCU may merely receive and transmit the backlight data once, so it is able to prevent the occurrence of such a situation where it is necessary for the MCU to transmit the data repeatedly when the backlight source driving circuitry is reused in a time-division manner, and significantly reduce the workload of the MCU, thereby to facilitate the MCU to process the other services.

The present disclosure further provides in some embodiments a backlight driving method for the above-mentioned backlight driving device, which includes: acquiring, by the MCU, backlight data about N*M regions corresponding to a current display image of a display device, and transmitting the backlight data about the N*M regions to the backlight source driving circuitry; and receiving, by the backlight source driving circuitry, the backlight data about the N*M regions from the MCU, and writing the backlight data about each region into a corresponding register, so as to enable each PWM output to control one or more display parameters of the corresponding region in accordance with the backlight data.

Different from the existing backlight source driving circuitry where each PWM output merely corresponds to one register, in the embodiments of the present disclosure, each PWM output of the backlight source driving circuitry may correspond to N registers, so it is able to perform multiple address allocation on each PWM output, thereby to write the backlight data into the N registers.

In the embodiments of the present disclosure, in each display image, the MCU may transmit the backlight data about the N*M regions to the backlight source driving circuitry in a one-time manner. The backlight source driving circuitry may receive the backlight data about the N*M regions from the MCU, and write the backlight data about each region into the corresponding register, so as to enable each PWM output to control luminance of the corresponding region in accordance with the backlight data. In the embodiments of the present disclosure, each of the PWM outputs of the backlight source driving circuitry may correspond to N registers, and each of the N*M registers of the backlight source driving circuitry may store the backlight data about the corresponding one of the N*M regions. As a result, it is able to prevent the occurrence of such a situation where it is necessary for the MCU to transmit the data to the backlight source driving circuitry repeatedly when the backlight source driving circuitry is reused in a time-division manner, and reduce a workload of the MCU, thereby to prevent the power consumption for the MCU from being increased and prevent the processing of the other services from being adversely affected.

The backlight driving method may further include: subjecting, by the MCU, a synchronization signal to frequency multiplication by N times, and transmitting the multiplied synchronization signal to N switches, so as to control the N switches to be turned on in a time-division manner.

The backlight driving method may further include: subjecting, by the MCU, the synchronization signal to frequency multiplication by N times and transmitting the multiplied synchronization signal to a backlight source driving circuitry; and accessing, by each PWM output, N registers corresponding to the PWM output one by one with the synchronization signal multiplied by N times as a reference, so as to control the luminance of the corresponding region in accordance with the backlight data.

The backlight driving method may further include: generating, by the upper computer, original backlight data in accordance with display data about the current display image of the display device, and transmitting the original backlight data and the synchronization signal to the MCU. The receiving, by the MCU, the backlight data about the N*M regions corresponding to the current display image of the display device may include: receiving, by the MCU, the original backlight data and the synchronization signal, and parsing the original backlight data so as to acquire the backlight data about the N*M regions.

Figure 2:
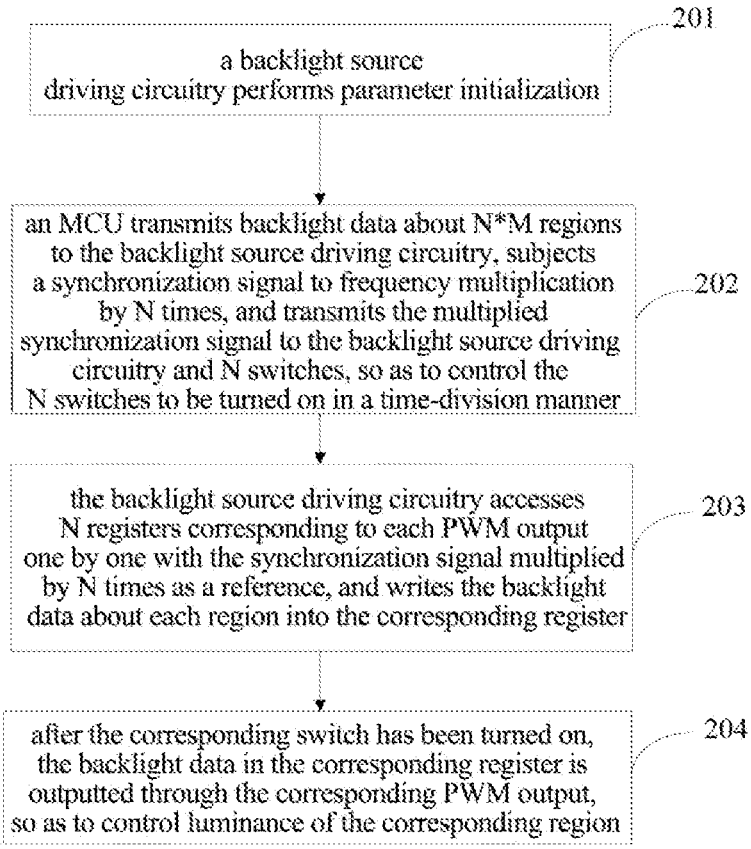
FIG. 2 is a flow chart of a backlight driving method according to one embodiment of the present disclosure.

As shown in FIG. 2, the backlight driving method may specifically include the following steps.

Step 201: the backlight source driving circuitry may perform parameter initialization.

After the MCU starts to work, it may initialize the backlight source driving circuitry, and the backlight source driving circuitry may release the N registers for storing the backlight data for each PWM output according to the practical need.

Step 202: the MCU may transmit the backlight data about the N*M regions to the backlight source driving circuitry, subject the synchronization signal to frequency multiplication by N times, and transmit the multiplied synchronization signal to the backlight source driving circuitry and the N switches, so as to control the N switches to be turned on in a time-division manner.

The MCU may receive the synchronization signal VSYNC from the upper computer, receive the backlight data from the upper computer, transmit the backlight data to the backlight source driving circuitry, then subject VSYNC to frequency multiplication by N times, and then transmit the multiplied VSYNC to the backlight resource driving circuitry, so as to control the N switches to be turned on in a time-division manner in accordance with the VSYNC multiplied by N times.

Step 203: the backlight source driving circuitry may access the N registers corresponding to each PWM output one by one with the synchronization signal multiplied by N times as a reference, and write the backlight data about each region into the corresponding register.

Step 204: after a corresponding switch has been turned on, the backlight data in the corresponding register may be outputted through the corresponding PWM output, so as to control the luminance of the corresponding region.

Figure 3:
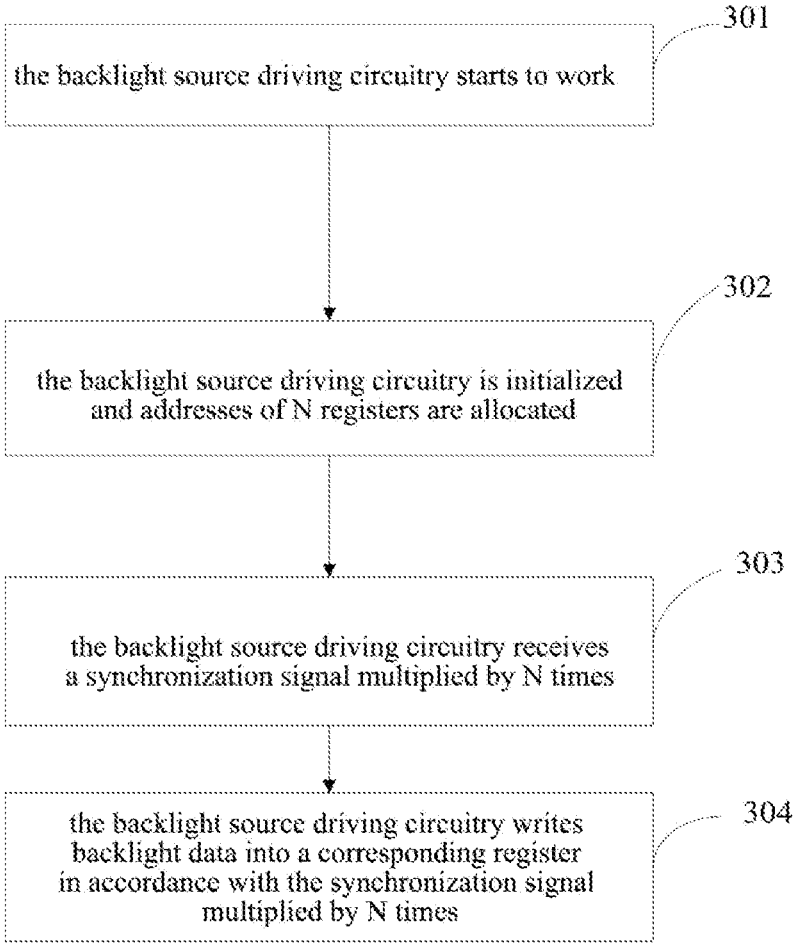
FIG. 3 is a schematic view showing an operating procedure of a backlight source driving circuitry according to one embodiment of the present disclosure.

As shown in FIG. 3, an operating procedure of the backlight source driving circuitry may include the following steps.

Step 301: the backlight source driving circuitry starts to work.

Step 302: the backlight source driving circuitry may be initialized and addresses of the N registers may be allocated.

The backlight source driving circuitry may be initialized in accordance with the parameter from the MCU, and then release the N registers for each PWM output in accordance with the request from the MCU.

Step 303: the backlight source driving circuitry may receive the synchronization signal multiplied by N times.

Step 304: the backlight source driving circuitry may write the data into the corresponding register in accordance with the synchronization signal multiplied by N times.

To be specific, upon the receipt of the synchronization signal, the backlight source driving circuitry may address the register corresponding to the current synchronization signal, and update the data stored in the corresponding register.

After the backlight source driving circuitry is in a normal operating state, it may address storage addresses of the N registers corresponding to each PWM output in accordance with the synchronization signal VSYNC_N multiplied by N times, access the N registers corresponding to each PWM output one by one, and update in real time the backlight data about the N*M regions into the N registers corresponding to each PWM output. Each register may store therein the backlight data about one region, and the N*M registers may store therein the backlight data about the N*M regions respectively. As a result, it is able to adjust a current for the corresponding region in accordance with the backlight data in the corresponding register, thereby to control the luminance of the corresponding region.

FIG. 4 shows a sequence of the signals. As shown in FIG. 4, within a display time period for each display image of the display device, the upper computer 14 may generate the original backlight data in accordance with the display data about the current display image of the display device, and transmit the original backlight data to the MCU 11 with the synchronization signal VSYNC as a reference. Upon the receipt of the backlight data, the MCU 11 may parse the original backlight data so as to acquire the backlight data about the N*M regions, transmit the backlight data about the N*M regions to the backlight source driving circuitry 12 in a one-time manner, and reset and address a start address. The MCU 11 may further subject the synchronization signal VSYNC to frequency multiplication by N times to acquire VSYNC_N, and transmit VSYNC_N to the backlight source driving circuitry 12. The backlight source driving circuitry 12 may include M PWM outputs. Each PWM output may address storage addresses of the N registers 12R corresponding to the PWM output with an order of the inputted VSYNC_N as a reference, and access the N registers corresponding to each PWM output one by one, so as to enable each PWM output to control the luminance of the corresponding region in accordance with the backlight data. The backlight data about the N*M regions may be updated in real time in the N registers corresponding to each PWM output. The backlight data about one region may be stored in one register, and the backlight regions about the N*M regions may be stored in the N*M registers respectively, so it is able to adjust a current for a corresponding region in accordance with the backlight data in the corresponding register, thereby to control the luminance of the corresponding region. Each register corresponding to each PWM output may correspond to one switch 13 and one LED group. When the corresponding switch 13 is turned on, the backlight data stored in the corresponding register may be outputted through the corresponding PWM output, so as to control the luminance of the corresponding LED group. The MCU 11 may control the N switches 13 to be turned on in a time-division manner in accordance with the multiplied VSYNC_N. In the embodiments of the present disclosure, within the display time period for each display image of the display device, the MCU may merely receive and transmit the backlight data once, so it is able to prevent the occurrence of such a situation where it is necessary for the MCU to transmit the data repeatedly when the backlight source driving circuitry is reused in a time-division manner, and significantly reduce the workload of the MCU, thereby to facilitate the MCU to process the other services.

The present disclosure further provides in some embodiments a backlight module including the above-mentioned backlight driving device.

The present disclosure further provides in some embodiments a display device including the above-mentioned backlight module. The display device may be any product or member having a display function, e.g., a liquid crystal television, a liquid crystal display, a digital photo frame, a mobile phone, or a flat-panel computer. The display device may further include a flexible circuit broad, a printed circuit board and a back plate.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "include" or "including" intends to indicate that an element or object before the word contains an element or object or equivalents thereof listed after the word, without excluding any other element or object. Such words as "connect/connected to" or "couple/coupled to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

It should be appreciated that, in the case that such an element as layer, film, region or substrate is arranged "on" or "under" another element, it may be directly arranged "on" or "under" the other element, or an intermediate element may be arranged therebetween.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A backlight driving device for a backlight module of a display device, wherein backlight source of the backlight module is divided into N*M regions, where M and N are each a positive integer, the backlight driving device comprising:

a Microcontroller Unit (MCU) configured to acquire backlight data about the N*M regions corresponding to a current display image of the display device;

a backlight source driving circuitry comprising M Pulse Width Modulation (PWM) outputs and N registers corresponding to each PWM output, wherein the N*M registers of the backlight source driving circuitry correspond to the N*M regions respectively, wherein the backlight source driving circuitry is configured to receive backlight data about the N*M regions from the MCU, and write the backlight data about each region into a corresponding register, so as to enable each PWM output to control one or more display parameters of the corresponding region in accordance with the backlight data; and N switches connected to the MCU, wherein each of the N switches corresponds to M regions, and the M regions corresponding to a same switch correspond to the M PWM outputs respectively, wherein the MCU is further configured to subject a synchronization signal to frequency multiplication by N times and transmit the multiplied synchronization signal to the N switches so as to control the N switches to be turned on in a time-division manner, and when one switch is turned on, the one or more display parameters of each of the M regions corresponding to the switch is controlled by the corresponding PWM output.

2. The backlight driving device according to claim 1, wherein the backlight source driving circuitry is further configured to receive the backlight data about the N*M regions from the MCU in a one-time manner.

3. The backlight driving device according to claim 1, wherein the one or more display parameters of the corresponding region comprises at least one of luminance, acutance and resolution of the corresponding region.

4. The backlight driving device according to claim 1, wherein the MCU is further configured to transmit the synchronization signal multiplied by N times to the backlight source driving circuitry, and each PWM output is further configured to access the N registers corresponding to the PWM output one by one with the synchronization signal multiplied by N times as a reference, so as to control the luminance of the corresponding region in accordance with the backlight data.

5. The backlight driving device according to claim 1, further comprising:

an upper computer configured to generate original backlight data in accordance with display data about the current display image of the display device, and transmit the original backlight data and the synchronization signal to the MCU, wherein the MCU is further configured to receive the original backlight data and the synchronization signal, and parse the original backlight data so as to acquire the backlight data about the N*M regions.

6. The backlight driving device according to claim 1, wherein each region of the backlight source comprises a Light-Emitting Diode (LED) group consisting of a plurality of LEDs connected to each other in series.

7. The backlight driving device according to claim 1, wherein each region of the backlight source comprises an LED group consisting of a plurality of LEDs connected to each other in parallel.

8. The backlight driving device according to claim 1, wherein each region of the backlight source comprises an LED group consisting of a plurality of LED subgroups connected to each other in parallel and each LED subgroup having LEDs connected to each other in series.

9. The backlight driving device according to claim 1, wherein the backlight source driving circuitry is further configured to release N registers for each PWM output in accordance with a request from the MCU.

10. The backlight driving device according to claim 1, wherein the backlight source driving circuitry is further configured to release the same quantity of registers in accordance with the quantity of N switches connected to the MCU.

11. The backlight driving device according to claim 1, wherein the current display image of the display device is a High-Dynamic Range (HDR) image.

12. A backlight driving method for a backlight driving device, wherein the backlight driving device is used for a backlight module of a display device, wherein backlight source of the backlight module is divided into N*M regions, where M and N are each a positive integer, the backlight driving device comprising: a Microcontroller Unit (MCU) configured to acquire backlight data about the N*M regions corresponding to a current display image of the display device;

a backlight source driving circuitry comprising M Pulse Width Modulation (PWM) outputs and N registers corresponding to each PWM output, wherein the N*M registers of the backlight source driving circuitry correspond to the N*M regions respectively, wherein the backlight source driving circuitry is configured to receive backlight data about the N*M regions from the MCU, and write the backlight data about each region into a corresponding register, so as to enable each PWM output to control one or more display parameters of the corresponding region in accordance with the backlight data; and N switches connected to the MCU, wherein each of the N switches corresponds to M regions, and the M regions corresponding to a same switch correspond to the M PWM outputs respectively, the backlight driving method comprising:

acquiring, by an MCU, backlight data about N*M regions corresponding to a current display image of a display device, and transmitting the backlight data about the N*M regions to a backlight source driving circuitry;

receiving, by the backlight source driving circuitry, the backlight data about the N*M regions from the MCU, and writing the backlight data about each region into a corresponding register, so as to enable each PWM output to control one or more display parameters of the corresponding region in accordance with the backlight data;

subjecting, by the MCU, the synchronization signal to frequency multiplication by N times and transmitting the multiplied synchronization signal to a backlight source driving circuitry; and accessing, by each PWM output, N registers corresponding to the PWM output one by one with the synchronization signal multiplied by N times as a reference, so as to control the one or more display parameters of the corresponding region in accordance with the backlight data.

13. The backlight driving method according to claim 12, wherein the backlight source driving circuitry is further configured to receive the backlight data about the N*M regions from the MCU in a one-time manner.

14. The backlight driving method according to claim 12, wherein the one or more display parameters of the corresponding region comprises at least one of luminance, acutance and resolution of the corresponding region.

15. The backlight driving method according to claim 12, further comprising:

subjecting, by the MCU, a synchronization signal to frequency multiplication by N times, and transmitting the multiplied synchronization signal to N switches, so as to control the N switches to be turned on in a time-division manner.

16. The backlight driving method according to claim 12, further comprising:

generating, by an upper computer, original backlight data in accordance with display data about the current display image of the display device, and transmitting the original backlight data and the synchronization signal to the MCU, wherein the receiving, by the MCU, the backlight data about the N*M regions corresponding to the current display image of the display device comprises receiving, by the MCU, the original backlight data and the synchronization signal, and parsing the original backlight data so as to acquire the backlight data about the N*M regions.

17. The backlight driving method according to claim 12, further comprising:

releasing, by the backlight source driving circuitry, N registers for each PWM output in accordance with a request from the MCU.

18. The backlight driving method according to claim 12, further comprising:

releasing, by the backlight source driving circuitry, the same quantity of registers in accordance with the quantity of N switches connected to the MCU.

* * * * *